United States Patent [19]

Johnson

[11] Patent Number: 4,553,557

[45] Date of Patent: Nov. 19, 1985

[54] HAIRPIN OPENER

[76] Inventor: Frances M. Johnson, 3739 Suncrest Dr., Lake Worth, Fla. 33463

[21] Appl. No.: 498,650

[22] Filed: May 27, 1983

[51] Int. Cl.[4] ..... A45D 44/00

[52] U.S. Cl. ..... 132/1 R; 132/50

[58] Field of Search ..... 132/1 R, 50; 63/2, 15, 63/15.1

[56] References Cited

U.S. PATENT DOCUMENTS

| | | | |
|---|---|---|---|
| 2,168,432 | 8/1939 | Ordal | 732/1 A |
| 2,710,612 | 6/1955 | Reilly | 132/1 R |
| 2,833,291 | 5/1958 | Campagna | 132/1 R |
| 3,338,118 | 8/1967 | McGahee | 132/1 R |
| 4,269,205 | 5/1981 | Clark | 132/45 R |

*Primary Examiner*—Gregory E. McNeill

*Attorney, Agent, or Firm*—Steele, Gould & Fried

[57] ABSTRACT

An apparatus for opening hairpins, adapted to be worn as a finger ring, comprising: an arched shell having a downwardly directed and rounded peripheral edge; a centrally disposed pedestal for supporting the shell in a raised position on a finger engaging assembly; and, a plurality of ribs and grooves radiating from the pedestal, in the inner surface of the shell, whereby upon slipping one end of a hairpin under the edge, the one end thereof catches in one of the grooves, which guides further movement of the hairpin substantially inwardly, until the hairpin has been sufficiently opened to be easily removed for use. In a presently preferred embodiment, the outer surface of the shell comprises a plurality of shallow textured depressions. The dimensions and shapes of the shell, the pedestal, the plurality of ribs and grooves and the plurality of depressions are randomized in a manner which enhances the decorative effect of a mushroom, without comprising the effectiveness of the apparatus.

20 Claims, 6 Drawing Figures

HAIRPIN OPENER

BACKGROUND OF THE INVENTION

1. Field of the Invention

This invention relates to the field of apparatus for opening hairpins in general, and in particular, to such apparatus which are adapted to be worn as finger rings. When so adapted, the useful features of the apparatus must be integrated into, or disguised by an ornamental design, which ornamental design may not interfere with use of the apparatus.

2. Prior Art

Hairpins can be particularly difficult to open. Unless one has two free hands, or unless one has particularly long fingernails, and is at the same time particularly dextrous, one usually opens a hairpin by utilizing one's teeth. Such a practice may be occasionally acceptable, if not somewhat dangerous. However, such a procedure is particularly unsanitary.

Hairdressers, perhaps more than those in any other occupation, must use large numbers of hairpins. It is rare when such a person has two free hands to use in opening hairpins, and the fact that such persons deal with the public, renders the unsanitary use of teeth completely unacceptable. Accordingly, such persons in particular have a special need for a small, convenient apparatus which can be used in conjunction with one free hand to easily open hairpins. Efforts heretofore have apparently been unsuccessful, despite a flurry of activity exemplified by the following patents.

A number of apparatus for opening hairpins are known in the art. Generally, such apparatus are disclosed in U.S. Pat. Nos.: Des. 153,758-Bennett; Des. 153,810-Koslap; Des. 156,867-Cogswell; 2,058,340-Miller; 2,481,209-Farnsworth; 2,511,768-Carlson; and, 2,581,592-Locke. Such apparatus have also been incorporated into finger rings, as shown in U.S. Pat. Nos.: Des. 133,110-Sohmer; Des. 158,249-Claflin; 477,825-Russell; 1,060,773-Litzman; 2,109,609-Aull; 2,150,144-Andersen; 2,402,236-Calafiore; 2,506,859-Des Saulles; and, 2,602,456-Le Master.

Of the various rings shown in the cited references, and intended for use in opening hairpins, all share several signficant drawbacks. Many are dangerous, in that sharp points and edges are presented. Many are quite difficult and impractical to use. All are unattractive, and therefore an embarrassment not likely to be ignored, particularly where the apparatus are marginally effective in the first instance.

This invention overcomes all of the foregoing drawbacks. The invention is safe, in that rounded, smooth edges are exposed. In this regard, the basic design is an arched shell; for example, a partial sphere or partial polyhedron having rounded corners and edges. A substantially quarter-spherical smooth shell is a preferred shell shape. The invention is very easy to use, and in fact includes ribs and grooves in the inner surface of the shell which positively guide movement of the hairpins as they are being opened. Finally, the invention incorporates the improved operating characteristics into a particularly attractive ornamental design, namely a mushroom.

SUMMARY OF THE INVENTION

It is an object of this invention to provide an apparatus which facilitates opening hairpins.

It is a further object of this invention to provide an apparatus which requires only one free hand for manipulation of the hairpin.

It is a still further object of this invention to provide an apparatus for opening hairpins, which facilitates one-handed manipulation by guiding movements of the hairpins.

It is yet another object of the invention to provide an apparatus for opening hairpins which may be worn on either hand.

It is another object of this invention to provide an apparatus for opening hairpins, wherein the useful aspects of the apparatus are camouflaged or disguised in an appealing ornamental design.

It is yet another object of this invention to provide an apparatus for opening hairpins which incorporates no sharp edges or points, with regard to both the useful aspects and the ornamental disguise.

It is yet another object of this invention to provide all of the foregoing features in an apparatus adapted to be worn as a finger ring.

These and other objects are accomplished by an apparatus for opening hairpins, adapted to be worn as a finger ring, comprising: an arched shell having a downwardly directed and rounded peripheral edge; a centrally disposed pedestal for supporting the shell in a raised position on a finger engaging means; and, a plurality of ribs and grooves radiating from the pedestal, in the inner surface of the shell, whereby upon slipping one end of a hairpin under the edge, the one end catches in one of the grooves, which guides further movement of the hairpin substantially inwardly, until the hairpin has been sufficiently opened to be easily removed for use.

Moreover, these and other objects are accomplished by incorporating the useful features of the invention into an ornamental design which disguises or camouflages such useful features, so as to prevent embarrassment, and to the contrary, promote use of the apparatus. In a presently preferred embodiment the ribs and grooves comprise a serrated surface configuration simulating the appearance of the underside of a mushroom cap; and, the outer surface of the shell comprises a plurality of shallow textured depressions further enhancing operation as well as the appearance of a mushroom. It is a particularly useful feature of the invention that the useful characteristics or features can be so arranged as to be incorporated into an attractive ornamental design.

BRIEF DESCRIPTION OF THE DRAWINGS

For the purpose of illustrating the invention, there are shown in the drawings forms which are presently preferred; it being understood however, that this invention is not limited to the precise arrangements and instrumentalities shown.

FIGS. 4 and 5(*b*) sequentially illustrate a hairpin being opened utilizing this invention, the position of the hairpin being substantially the same in FIGS. 4 and 5(*a*).

DETAILED DESCRIPTION OF THE PREFERRED EMBODIMENTS

Figure 1:
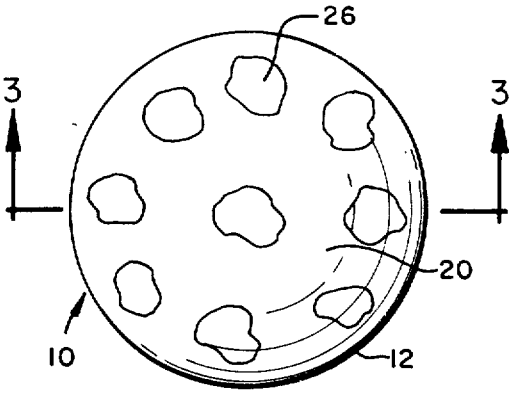
FIG. 1 is a top plan view of an apparatus for opening hairpins according to this invention.
Figure 2:
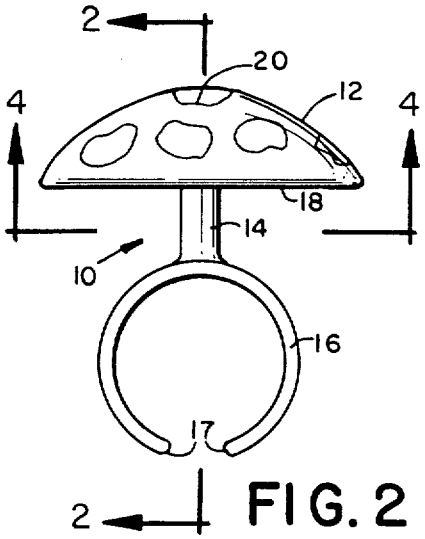
FIG. 2 is a side elevation of FIG. 1.
Figure 3:
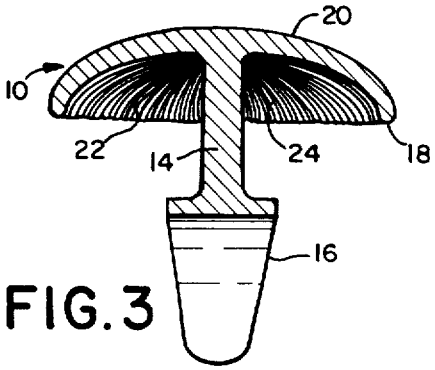
FIG. 3 is a section view taken along the line 3—3 of FIG. 1.

An apparatus 10 for use in opening hairpins and the like, and adapted to be worn as a ring is shown in FIGS. 1-4. The apparatus 10 comprises an arched shell in the shape of a truncated hollow spherical, oblong or polyhedral body. Preferably, a substantially quarter-spherical shell 12 is mounted on one end of a pedestal 14. In this context, a quarter-spherical shell may be thought of as the upper half of a hemispherical shell; and, a portion of a spherical shell as a polyhedral shell having a very large number of sides or facets. The other end of the pedestal 14 is fixed to a finger engaging means 16. The apparatus may therefore be worn on any finger of either hand, depending only upon the relative size of the opening of the finger engaging means 16. Finger engaging means 16 is adjustable in size, as ends 17 may be bent toward and away from one another. The outer edge 18 of the shell is substantially smooth, being directed substantially downwardly and somewhat outwardly. In polyhedral shapes, all corners and edges around outer edge 18 should be rounded slightly, for example to a radius approaching the opening of a hairpin. The shell 12 has an outer surface 20, an inner surface 22, and a plurality of inner radially directed ribs or ridges 24 defining a plurality of grooves 25 therebetween.

The overall appearance of the apparatus 10 simulates the appearance of a mushroom. The ribs and grooves form a serrated surface configuration simulating the appearance of the underside of a mushroom cap. The term serrated is apt as, in the presently preferred embodiment, the grooves have a curved or arcuate form in cross-section. The outer surface 20 of the shell is provided with a plurality of textured areas in the form of shallow grooves 26, further enhancing the decorative effect. Although the apparatus 10 is illustrated as regular and symmetrical in form, each of the various features and dimensions may be somewhat distorted, in order to effect an appearance which more closely resembles a real mushroom. In order to encourage persons to wear such an apparatus, it is an important aspect of this invention that its utilitarian functions can be disguised or camouflaged in such an attractive decorative embodiment. The serrated surface formed by the ribs and grooves, the grooves having the substantially circular recessed surface, in cross-section enhances the ability to "catch" the ends of hairpins and the like inserted under the edge, without dislodging the hairpins from the grip of the user.

The apparatus 10 may be molded, cast, stamped and/or assembled in plastic or metal. In the presently preferred embodiment, the apparatus is formed from scratch resistant metal. Precious metals such as gold and silver are also possible and enhance the decorative aspects of the apparatus. Of course, decorative metal leaf, inlays and the like are also contemplated.

Figure 4:
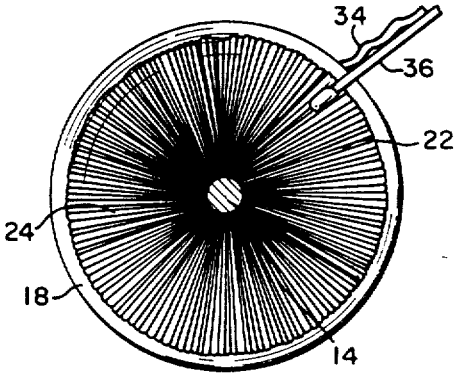
FIG. 4 is a section view taken along the line 4—4 in FIG. 2.
Figure 5:
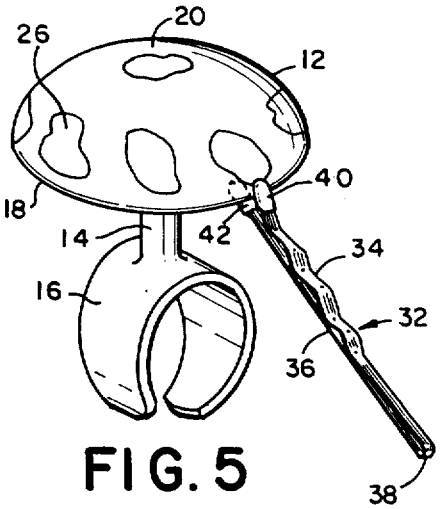
FIGS. 5(*a*) and 5(*b*) are front perspective views.
Figure 6:
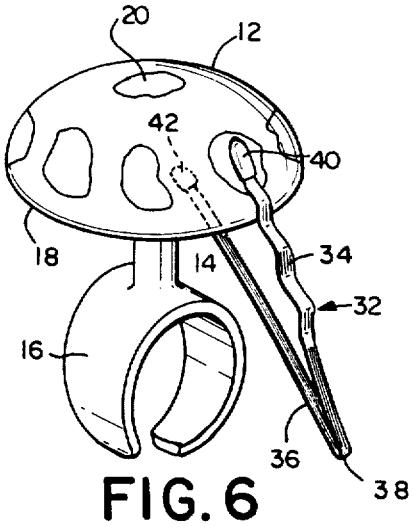

Use of the apparatus 10 in opening a hairpin 32 is sequentially illustrated in FIGS. 4 and 5(*a*), and 5(*b*). The apparatus 10 is worn as a ring on one finger of one hand. A hairpin 32 comprises an upper pin half 34 and a lower pin half 36 joined together with a hinge portion 38. The pin 32 may be grasped between the tips of fingers of the other hand at the hinge portion 38. The pin 32 is pushed into engagement with the arched shell 12 of the apparatus 10 by aligning the end 40 of upper pin half 34 to pass over edge 18 and the end 42 of lower pin half 36 to pass under edge 18. As the end 42 of the lower pin half 36 slides along the inner surface 22, the end will slip into or engage in one of the grooves 26 of the serrated surface formed by ribs 24. Further inward pressure and movement of the pin radially inwardly toward the center of the hemispherical shell 12 will result in the pin 32 being partially opened, the pin most likely being substantially aligned with one of the grooves.

Still further inward movement and pressure of the pin 32 will result in the end 42 being guided further into a groove, as shown in FIG. 5(*b*). The guidance provided by the grooves and ribs is particularly helpful in controlling the opening of the hairpin, and reducing the likelihood that the hairpin would inadvertently dislodge and "snap" off of the apparatus. After the hairpin 32 has been pushed into the position shown in FIG. 5(*b*), it can be easily removed in its opened condition, and used as required. The grooves 26 guide and direct movement of the hairpins and the like throughout the opening process. The substantially symmetrical arrangement of the grooves 26, on a substantially symmetrical shell 12, enables the ring to be worn on any finger of either hand, and still be convenient to use.

It can be appreciated that even if the various dimensions and symmetries of the apparatus are distorted, in order to effect an even more realistic depiction of a mushroom, the apparatus will nevertheless be just as effective for use in opening hairpins and the like. Although the ribs 25 and grooves 26 are illustrated as being particularly regular, it will be appreciated that these too can be randomized somewhat without hindering the utilitarian advantages of the invention.

This invention may be embodied in other specific forms without departing from the spirit or essential attributes thereof, and accordingly, reference should be made to the appended claims, rather than to the foregoing specification, as indicating the scope of the invention.

What is claimed is:

1. An apparatus for use in opening hairpins and the like, adapted to be worn on a finger, comprising:

an arched shell having a smooth edge;

a centrally disposed pedestal for supporting the shell on finger engaging means; and, a plurality of ribs and grooves in the inner surface of the shell, radiating from the pedestal, each having one end adjacent the edge of the shell, whereby upon slipping one end of a hairpin and the like under the edge, the one end most often catches in one of the grooves, the groove guiding and directing the pin inwardly in a movement which opens the hairpin and the like simultaneously with the inward movement.

2. The apparatus of claim 1, wherein the arched shell is a substantially quarter-spherical shell.

3. The apparatus of claim 1, wherein the arched shell is a truncated polyhedral shell.

4. The apparatus of claim 1, wherein the grooves and ribs define a serrated configuration on the inner surface of the shell, having the appearance of the underside of a mushroom, and further comprising the outer surface of the shell having a plurality of shallow textured depressions having the appearance of the upper surface of a mushroom.

5. The apparatus of claim 1, wherein the dimensions and shapes of the shell, the supporting pedestal and the plurality of ribs and grooves are randomized in a manner which enhances the decorative effect of a mushroom, without compromising the effectiveness of the apparatus.

6. The apparatus of claim 4, wherein the dimensions and shapes of the shell, the supporting pedestal, the plurality of ribs and grooves and the plurality of depressions are randomized in a manner which enhances the decorative effect of a mushroom, without compromising the effectiveness of the apparatus.

7. The apparatus of claim 1, wherein the apparatus is formed from metal.

8. The apparatus of claim 1, wherein the apparatus is formed from plastic.

9. The apparatus of claim 7, wherein the apparatus comprises gold.

10. The apparatus of claim 7, wherein the apparatus comprises silver.

11. The apparatus of claim 1, wherein the grooves have an arcuate shape in cross-section, defining a serrated surface configuration.

12. The apparatus of claim 1, wherein the edge of the shell is directly substantially downwardly and somewhat outwardly.

13. An apparatus for use in opening hairpins and the like, adapted to be worn on a finger, comprising:

an arched shell having a smooth edge;

a finger-engaging means; and, a centrally disposed pedestal for supporting the shell on the finger engaging means, the pedestal being narrower than the arched shell, whereby upon slipping opposed legs of an end of a hairpin over the edge of the arched shell, said opposed legs are separated by the arched shell and are easily grasped.

14. The apparatus of claim 13, wherein the arched shell is a substantially quarter-spherical shell.

15. The apparatus of claim 13, wherein the arched shell is oblong.

16. The apparatus of claim 13, wherein the arched shell is a truncated polyhedral shell.

17. The apparatus of claim 13, wherein the arched shell has rounded corners.

18. The apparatus of claim 13, further comprising grooves and ribs defining a serrated configuration on the inner surface of the shell, the grooves and ribs radiating from the pedestal.

19. The apparatus of claim 18, wherein the shell and pedestal have a mushroom appearance.

20. The apparatus of claim 19 further comprising the outer surface of the shell having a plurality of shallow textured depressions having the appearance of the upper surface of a textured surface mushroom.

* * * * *